US006003704A

United States Patent [19]

Grigsby, Jr.

[11] Patent Number: 6,003,704

[45] Date of Patent: Dec. 21, 1999

[54] SELF-SQUARING WOOD CLEATED CRATE

[75] Inventor: John M. Grigsby, Jr., Woodstock, Ga.

[73] Assignee: North American Container Corporation, Mabelton, Ga.

[21] Appl. No.: 09/107,791

[22] Filed: Jun. 30, 1998

[51] Int. Cl.[6] ..... B65D 9/00

[52] U.S. Cl. ..... 217/16; 217/48

[58] Field of Search ..... 217/15, 16, 47, 217/48; 220/4.29

[56] References Cited

U.S. PATENT DOCUMENTS

| | | | |
|---|---|---|---|
| 2,042,323 | 5/1936 | Ott | 217/16 |
| 2,042,339 | 5/1936 | Henderson | 217/16 |
| 2,110,150 | 3/1938 | Hile | 217/16 |
| 2,141,497 | 12/1938 | Watkins | 217/48 |
| 2,159,642 | 5/1939 | Watkins | 217/48 |
| 2,525,838 | 10/1950 | Smith et al. | 217/16 |
| 2,609,957 | 9/1952 | Sester | 217/48 |
| 2,672,252 | 3/1954 | Frear | 217/48 |
| 2,799,420 | 7/1957 | Dedmon | 217/48 |
| 2,808,956 | 10/1957 | Johnson | 217/48 |
| 3,451,578 | 6/1969 | Edmundson | 217/48 |
| 3,459,321 | 8/1969 | Wait | 217/16 |
| 3,493,141 | 2/1970 | Salter | 217/48 |
| 3,727,786 | 4/1973 | Fausel | 217/16 |
| 3,874,543 | 4/1975 | Farnsworth | 217/48 |
| 4,120,417 | 10/1978 | Aquino | 220/6 |
| 5,813,555 | 11/1998 | Grigsby . | |
| 5,829,189 | 11/1998 | Grigsby . | |

FOREIGN PATENT DOCUMENTS

| | | |
|---|---|---|
| 500520 | 3/1954 | Canada . |
| 311983 | 5/1929 | Sweden . |

*Primary Examiner*—Steven Pollard
*Attorney, Agent, or Firm*—Kennedy, Davis & Hodge

[57] ABSTRACT

A cleated crate having opposing side panels and opposing end panels, hingedly connected together pairs of opposing inner and outer hinges which define corners in the crate. Each hinge comprises a pair of members having trapezoidal shapes in cross-section which defines a neck surface and an opposing shoulder surface and an oblique surface and an opposing back surface. The elongated members in the inner hinges are disposed in mirrored relation with the necks side-by-side and the oblique surfaces defining a V-shaped channel on a side of the hinge. The members are secured together by a pair of U-shaped staples driven into the butt ends. The members pivot to a second position for bringing the oblique surfaces into bearing contact. The elongated members in the outer hinges are disposed in mirrored relation with the distal edges of the members defined by the respective oblique surface and the shoulder surface in touching contact. The oblique surfaces define a V-shaped channel on a side of the hinge. The members are joined together by a pair of plates attached at opposing distal ends. The members pivot on the plates to a second position for bringing the oblique surfaces into bearing contact.

3 Claims, 3 Drawing Sheets

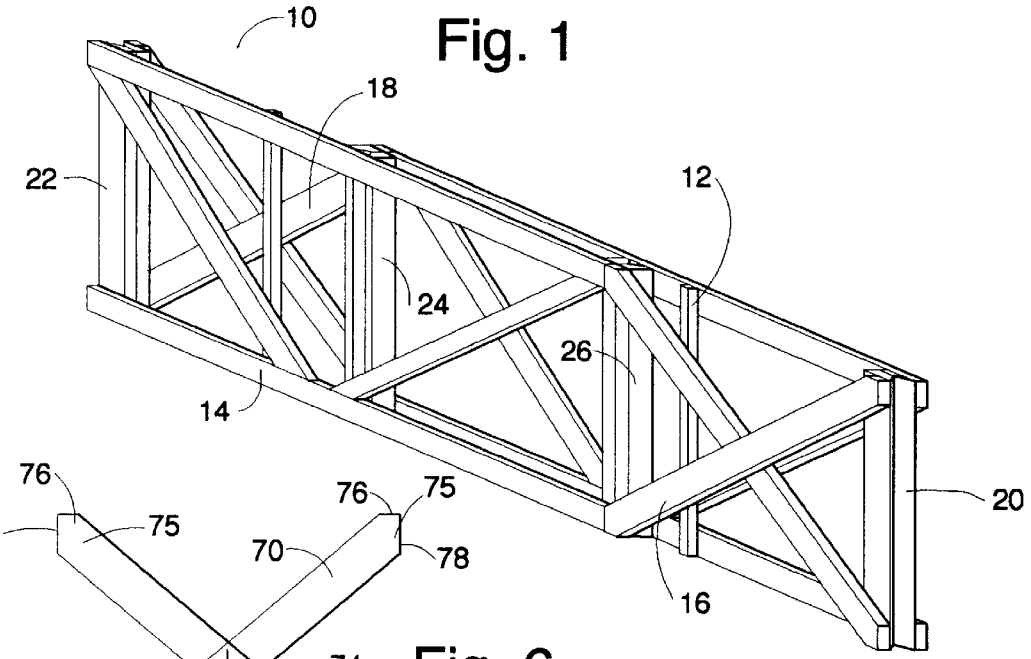
Fig. 1
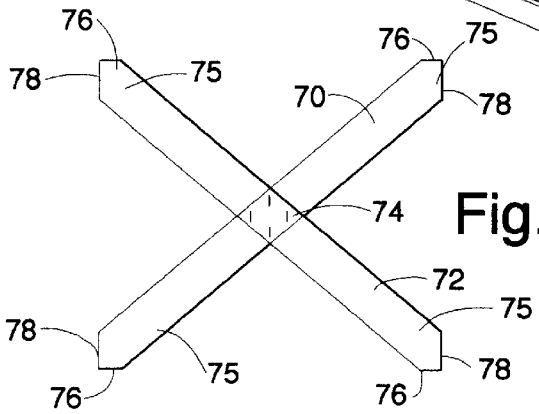
Fig. 6
Fig. 7
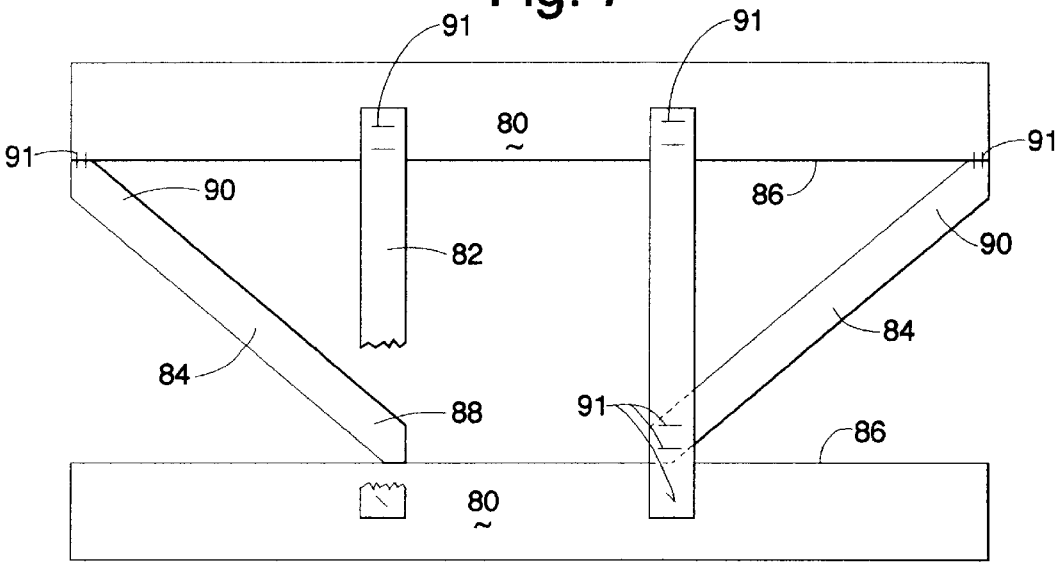

Fig. 2
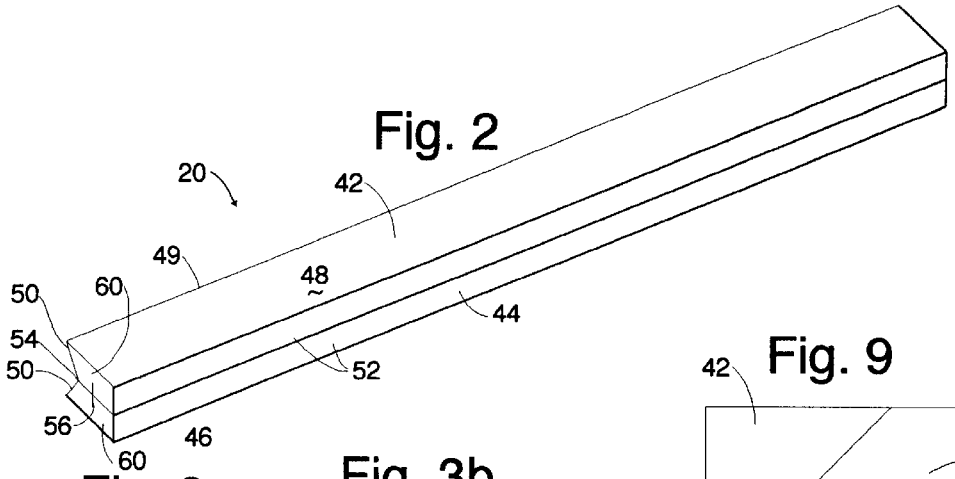
Fig. 9
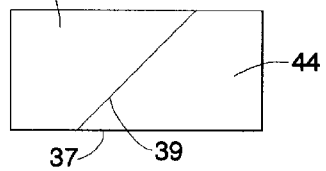
Fig. 3a
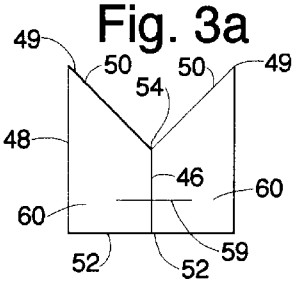
Fig. 3b
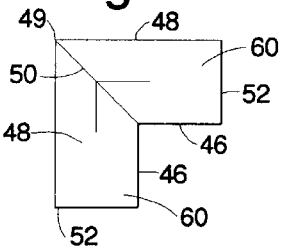
Fig. 4
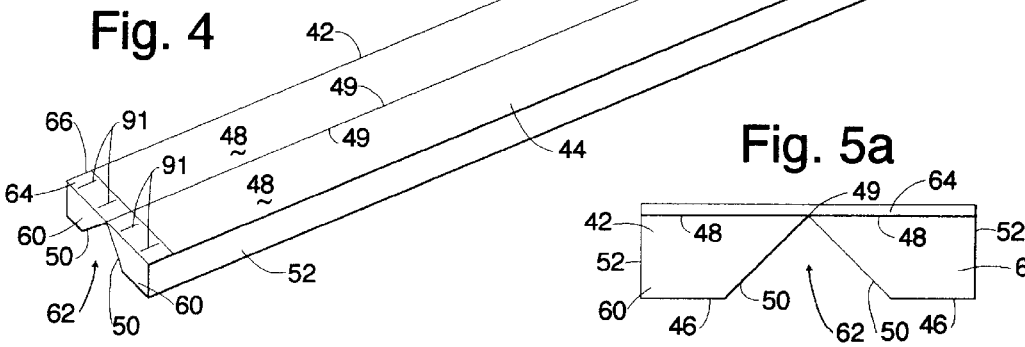
Fig. 5a
Fig. 5b
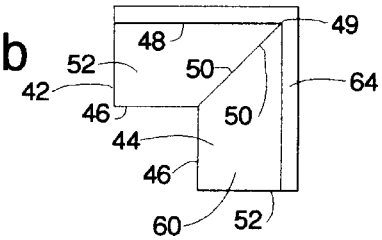

SELF-SQUARING WOOD CLEATED CRATE

TECHNICAL FIELD

The present invention relates generally to crates for packing heavy goods. More particularly, the present invention relates to wood cleated crates which square open with improved hinging of adjacent panels in the crate for packaging heavy goods for longterm, outdoor storage, as well as for handling and shipping of such heavy goods.

BACKGROUND OF THE INVENTION

Manufacturers of large, heavy durable goods such as lawn and garden equipment, recreational vehicles, and appliances, package the goods in containers for handling, storing, and shipping the goods from manufactures to consumers. Often the containers with the goods are stored in warehouses waiting for distribution by trucks or other vehicles to retailers and to consumers. The containers are typically stacked in warehouses in order to conserve space, and generally are stacked four to six containers high. The crates must have strong tensile strength to permit shipping and storage of stacks of crates. Also, the upper units in stacked shipment exert large "racking" forces on the lower units. The racking forces a rise from the momentum of the upper units as truck trailers or rail cars change velocity, start, and stop. These forces tend to loosen the staples applied to the corners of the crates. Loosened staples reduce the rigidity of the crate and may cause the crate to collapse, causing damage to the product contained therein and may result in injury or safety hazards to persons nearby.

The structural components of the containers accordingly must allow for handling by specialized material handling equipment such as forklift trucks, clamp trucks and the like while also protecting the products held in the container. The container must provide for stacking, whereby top loads are transferred through the containers to the bases. Wood cleated corrugated paperboard containers such as that shown in U.S. Pat. No. 4,832,256 generally have meet the packaging needs of manufacturers of durable goods. The article, such as a tractor, sits on a rigid wood base which receives a wood cleat reinforced corrugated paperboard body. The body is formed from a blank of corrugated paperboard material folded on scores to define main panels. The ends of the blank join with adhesive to define a tubular body. The body folds on the scores to a knocked-down configuration. The body is squared-open on the assembly line and lifted over the tractor on the wood base. Staples secure the corrugated paperboard body to the wood base. While these cleated corrugated containers meet the needs for low cost containers having durability and load-bearing performance, added protection is required for use in outside, unprotected environments. These protections often involve water resistant coatings or other water repellant features to reduce the effects of moisture on the corrugated panels.

Some manufacturers of lawn and garden tractors and riding lawn mowers package the goods in wood cleated crates. Wood cleated crates are particularly suited for long term outside storage. Conventional wood cleated crates for packaging such articles typically are comprised of separate loose sides, ends, tops, and bases. These components are known in the trade as "crate shook". Two sides and two ends are used together with a base and a top for assembly of a wood cleated crate. The separate components are stapled or nailed together at the assembly line during packaging of the goods. This requires much assembly line labor, fasteners, and time. The crate-line personnel must keep up with the line speed to prevent backups or being overwhelmed with products for packaging. One problem with using crate shook on assembly lines is the consistency of assembly of the components to form a complete crate. The crating line personnel must quickly align edges of the components, hold the components in position, and use conventional air-held air staple guns to connect the components together.

Various crates have been proposed to overcome the need to assemble crate shook during packaging. One type of such crates is known as wire bound wood crates. The opposing sides and opposing ends are positioned side-by-side and strands of steel wire are stapled girth wise to the faces of the sides and ends. The strands of wire join the sides and ends together. Typically there are five to seven strands of wires which extend the full length horizontally across the two sides and two ends. Staples are used to attach the wires to the crate shook. The wire strands form "hinges" across the adjacent sides and ends. The hinges permit the mat to fold. The mat thereafter wraps around the base which supports the heavy article to be packaged. The final corners in the crate is formed by hand stapling the adjacent edges of the side and end or by being tied with wire twists. A top frame made of wood is then set in place and stapled to the crate.

Although wire bound wood crates minimize the stapling required to assemble the crate, there are disadvantages involved with using such crates. The wires are long and interfere with disposal and recycling efforts. Continuous wire strands make manufacturing of the mat easier but it is difficult and impractical to extract the hundreds of staples which secure the wires to the crate shook, in order to dispose of the wood components after the crate has served its purpose. The wires also make grinding the wood components impractical. Such wire bound crates accordingly must be burned or placed in land fills for disposal. Such disposal techniques are no longer environmentally satisfactory.

The wire bound crates are also difficult to handle while packaging. The crates are shipped as long mats which take up significant space in warehouses and delivery trucks. Each mat is manually folded around the base during packaging. Manual handling of the extended mats is difficult and awkward. The wire-type corners that define the hinges also are typically stiff and difficult to fold into squared-up corners. The resulting crates mis-alignments or angled components, may cause stacks of such crates to lean or even to fold.

Accordingly, there remains a need in the art for cleated crates which are free of such disadvantages while providing a wood cleated crate for packaging heavy goods on assembly lines. It is to the provision of such that the present invention is directed.

SUMMARY OF THE PRESENT INVENTION

The present invention solves the need in the art by providing an improved unitary wood cleated crated having hinged corners connecting the opposing sides and end panels together for knocked-down shipping and self-squaring for use during packaging of heavy article. The cleated crate has opposing side panels and opposing end panels joined together with a pair of inner hinges and a pair of outer hinges. The side panels comprise a pair of spaced-apart, substantially parallel rails connected by a pair of spaced-apart transverse members and a pair of diagonal members extending at an oblique angle between a distal end portion of the transverse members to the opposing rails. The end panels comprise a pair of diagonally disposed members joined at an overlapping intersection of the pair of members.

The inner hinges and the outer hinges define corners in the cleated crate. The hinges each comprise a pair of elongated members having a trapezoidal shape in cross-section which defines a neck surface and an opposing shoulder surface and an oblique surface and an opposing back surface.

The elongated members in the inner hinges are disposed in a first position in mirrored relation with the necks disposed side-by-side and the oblique surfaces defining a V-shaped channel on a side of the hinge. A pair of U-shaped staples, each having a pair of legs and a bridge, are driven into the butt ends of the pair of elongated members with the legs in respective ones of the adjacent elongated members and the bridge disposed substantially perpendicular to a line defined by the side-by-side neck surfaces. The inner hinge pivots to a second position to bring the opposing oblique surfaces into engagement while disposing the pair of members at a perpendicular angle to define an angled corner post for the cleated crate.

The elongated members in the outer hinges are disposed in a third position in mirrored relation with the distal edges of the members defined by the respective oblique surface and the shoulder surface in touching contact and the oblique surfaces defining a V-shaped channel on a side of the hinge. A pair of plates attach transverse to a longitudinal axis of the elongated members at opposing distal ends for securing the pair of elongated members together. The outer hinge pivots to a fourth position to bring the opposing oblique surfaces into engagement while disposing the pair of members at a perpendicular angle to define an angled corner post for the cleated crate.

The inner and outer hinges join the opposing side panels and opposing end panels at respective distal ends to define a tubular cleated body moveable from a first knocked-down position to a second squared-open position by moving the side panels in opposing directions to pivot the inner hinges to their second positions and the outer hinges to their fourth position, for receiving the squared-open cleated body on a pallet.

Objects, features and advantages of the present invention will become apparent reading the following detailed description of the present invention, in conjunction with the appended drawings and claims.

BRIEF DESCRIPTION OF THE DRAWINGS

FIG. 1 is a perspective view of a partially opened cleated crate according to the present invention.

FIG. 2 is a perspective view of an outside hinge for connecting an adjacent end and side panel in the crate illustrated in FIG. 1.

FIGS. 3*a* and 3*b* are end views of the outside hinge illustrated in FIG. 2.

FIG. 4 is a perspective of a inside hinge for connecting an adjacent side and end panel in the cleated crated illustrated in FIG. 1.

FIGS. 5*a* and 5*b* are end views of the inside hinge illustrated in FIG. 4.

FIG. 6 is a plan view of an end panel for use in the cleated crate illustrated in FIG. 1.

FIG. 7 is a side panel for use in the cleated crate illustrated in FIG. 1.

FIG. 9 is a end view illustrating an elongate member cut on an oblique line to define the members for the hinges illustrated in FIGS. 2 and 4.

DETAILED DESCRIPTION OF THE PREFERRED EMBODIMENTS

Figure 8:
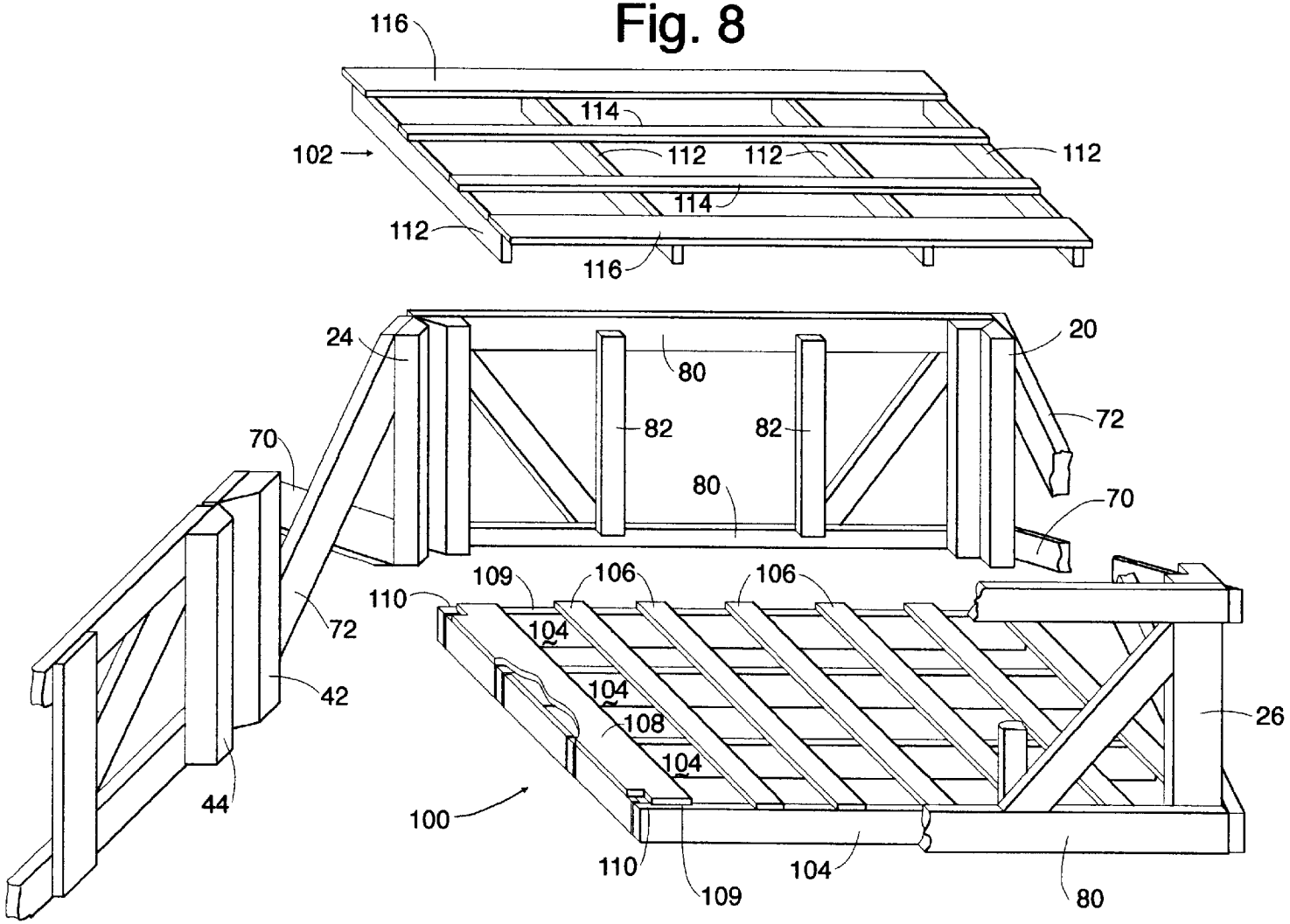
FIG. 8 is a perspective cut-away view of the cleated crate according to the present invention.

Referring now in more detail to the drawings in which like parts have like identifiers, FIG. 1 is a perspective view of a preferred embodiment of a cleated crate 10 in accordance with the present invention. The cleated crate 10 has a pair of opposing side panels 12, 14 and a pair of opposing end panels 16, 18. The side panels 12, 14 and end panels 16, 18 hingedly connect together with a pair of opposing outside hinges 20, 22 and a pair of opposing inside hinges 24, 26. The hinges 20, 22, 24, and 26 permit the crate 10 to open from a collapsed, knock-down position (as illustrated in FIG. 1) to a squared-open position for attaching to a base to package a heavy durable good (as illustrated in FIG. 8). The crate 10 is shipped in the substantially flat, knocked-down position from the crate manufacturer to the user of the crate. The outside hinges 20, 22 and the inside hinges 24, 26 of the present invention enable the crate 10 to square open quickly, accurately and generally without over-opening to an angle in excess of 90 degrees. The hinges 20, 22, 24 and 26 fold to square-open the crate body as well as to define the four corners of the cleated crate 10.

FIG. 2 is a perspective view of the outside hinge 20, which is identical to the other outside hinge 22. The outside hinge 20 comprises a pair of elongate members 42 and 44. The members 42 and 44 are identical and disposed in facing mirrored relation. The members 42, 44 have a trapezoidal shape in cross-sectional view and define a neck surface 46 and an opposing shoulder surface 48, being named such because the width of the member 42, 44 across the shoulder 48 is wider than across the neck 46. The shoulder 48 has a distal edge 49. The members 42, 44 also each define an oblique surface 50 and an opposing back surface 52 that is disposed at an perpendicular angle to the neck and shoulder faces 46 and 48. The oblique surface 50 preferably defines a 45 degree angle relative to the surface of the shoulder 48.

The outside hinge 20 is defined by the members 42, 44 disposed in mirrored relation, with the necks 46 disposed side-by-side and in contact to one another (as illustrated in end view in FIG. 3*a*). The facing oblique surfaces 50 of the members 42, 44 define a V-channel 54 on a side of the hinge 20. The members 40 and 42 are joined together by staples 56. The staples are of a conventional U-shape having a pair of legs and a bridge 59. The legs are driven into a respective one of the butt ends 60 of the adjacent members 42, 44. The bridge 59 of the U-shape staple is disposed substantially perpendicular to a line defined by the side-by-side neck surfaces 46. A single staple is driven into the aligned distal butt ends 60 at each distal end of the outside hinge 20. As illustrated in FIG. 3*b*, the staples permit the outside hinge 20 to pivot from a first position to a second position in order to bring the opposing oblique faces 50 into contact with another while disposing the pair of members 42, 44 at a perpendicular angle to each other in order to define an angled corner post for the cleated crate 10.

FIG. 4 is a perspective view of an inside hinge 24, which is identical to the inside hinge 26. The inside hinge 24 likewise comprises a pair of the elongate members 42, 44. For the inside hinge 24, the elongate members 42, 44 are disposed in mirrored relation with the distal edges 59 of the shoulders 48 in touching contact. As illustrated in the end view in FIG. 5*a*, the oblique surfaces 50 define a V-shaped channel 62 on a side of the hinge 24. A pair of plates 64 are disposed transverse to a longitudinal axis of the elongate members 42, 44, which plates 64 overlap the adjacent edges 59. The plates 64 are attached at opposing distal ends 66, 68 of the members 42, 44 for securing the pair of elongated members together. As illustrated in FIG. 5*b*, the hinge 24 pivots from a first position to a second position to bring the opposing oblique surfaces 50 into contact while disposing the pair of members 42, 44 at a perpendicular angle to each other, to define an angled corner post for the cleated crate 10.

FIG. 6 is a plan view of the end panel 16. The end panel 18 is identical. The end panel 16 is formed with a pair of elongated members 70, 72 which are joined by staples at an overlapping intersection 74 to define an X-shape. Each of the distal ends 75, 78 of each member 70, 72 is double beveled on the sides 76, 78.

FIG. 7 is a plan view of a side panel 12. The side panel 14 is identical. The side panel 16 is defined by a pair of spaced apart parallel elongate members 80. A pair of spaced apart transverse members 82 attach with staples to a central portion of the side panel 12. A member 84 extends diagonally between inner faces 86 of the elongate members 80. The distal ends 85 of the members 84 are likewise double-beveled 88, 90. The beveled end 88 seats in a notch defined by an edge face 86 of the elongate member 80 and a side face of the transverse member 82. Staples 91 secure the members 87 to the members 80 and 82.

FIG. 8 is a perspective view of the cleated crate 10 with a base 100 and a top frame 102. The base 100 in the illustrated embodiment has four runners 104 disposed parallel to each other. A plurality of intermediate members 106 are disposed spaced-apart transverse to the runners 104. The transverse members 106 attach with staples or nails to the runners 104 at overlapping intersections. The transverse members 106 support a heavy article such as a lawn and garden tractor (not illustrated) to be held in the cleated crate. An end member 108 is attached at opposing distal ends of the base 100. Each distal end of the member 108 includes a mortise 109 and a tennon 110 for receiving the lower ends of the members 42 and 44, in the respective corners of the base 100.

The top frame 102 comprises a plurality of spaced-apart transverse members 112 joined to a pair of longitudinal inside members 114 and outside members 116. The outside members 116 extend laterally of the distal ends of the members 112. The laterally extending portion of the outside members 116 rest on the top rails 80 of the side panels 12 and 14 when the cleated crate 10 is assembled.

With reference to FIGS. 1 and 8, the body of the self-squaring cleated crate 10 assembles by attaching the outside hinges 20, 22 and the inside hinges 24, 26 to respective ends of the end panels 16, 18 and the side panels 12, 14. The elongate members 42, 44 align with the beveled surfaces 78 of the members 70, 72 in the end panels 16, 18 and with the end faces of the members 80 in the side panels 12, 14. The hinges 20, 22, 24, and 26 attach with staples to the members in the panels. The body of the cleated crate 10 accordingly is assembled in a substantially flat knocked-down position. The body 10 is readily handled for storing and shipping in stack of such crate bodies from a crate manufacturer to a company manufacturing products to be packaged in the cleated crate 10.

The cleated crate 10 is used to package heavy durable goods. Generally, the goods travel on an assembly line to a packing station. The base pallet 100 receives the article to be packed. The crate body 10 is then squared-open from the knocked-down position to a substantially rectangular body as illustrated in cut-away view in FIG. 8. The crate 10 is squared-open by grasping the crate 10 by the upper members 80 on the side panels 12 and 14. The side panel 14 is moved laterally away from the opposing side panel 12 with pivoting of the hinges 20, 22 and 24, 26. In the inside hinges 24, 26, the plates 64 fold along the edges 49. The inside hinges 24, 26 pivot to bring the opposing faces 50 together and thereby position the members 42, 44 at a perpendicular angle to each other as shown in FIGS. 3*a* and 3*b*. The outside hinges 20, 22 pivot on the staples 56 in the butt ends 60 of the members. The bridge 59 of the staple bends to define an approximate 90 degree angle as the faces 50 are brought into bearing contact, as illustrated in FIG. 5*a* and 5*b*. The members 42, 44 are thereby disposed at a perpendicular angle to each other to define a corner of the cleated crate 10.

The crate 10 is then secured to the pallet 100 by driving nails or staples through the lower elongate members 80 into the pallet. The heavy article (not illustrated) supported by the pallet 100 is preferably wrapped with plastic to keep dust and water from contacting article. The top frame 102 is received on the upper ends of the corners defined by the hinges 20, 22, 24 and 26. The top frame is secured to the crate 10 by nails or staples driven through the upper elongate members 80. The extending outwardly portions of the members 116 rest on the upper edge of the upper members 80.

As illustrated in end view in FIG. 9, the members 42, 44 are preferably cut from a single elongate rectangular cross-section member 37 on an oblique line 39 to define the oblique surfaces 50 of the member. One of the members is reversed relative to the other to form the hinges 20, 24. The effect is to increase the strength of the corners formed by the hinges in the second position. This improvement arises from the tendency of an elongated member to bow under load. The members 42, 44 are reversed relative to each other. The member 42 tends to bow towards the opposing member 44 which also tends to bow towards member 42. The members bear against each other and resist bowing. The corners accordingly remaining vertical under increased loading.

It is thus seen that an improved cleated crate is provided for containing heavy durable goods for shipping, storage, and handling. While this invention has been described in detail with particular reference to the preferred embodiments thereof, the principals and modes of operation of the present invention have been described in the foregoing specification. The invention is not to be construed as limited to the particular forms disclosed, because these are regarded as a illustrative rather than restrictive. Moreover, variations, modifications, and changes may be made by those skilled the art without departure from the spirit and scope of the invention as described in the following claims.

What is claimed is:

1. A cleated crate having opposing side panels and opposing end panels, the side panels comprising a pair of spaced-apart, substantially parallel rails connected by a pair of spaced-apart transverse members and a pair of diagonal members extending at an oblique angle between a distal end portion of the transverse members to the opposing rails, the end panels comprising a pair of diagonally disposed members joined at an overlapping intersection of the pair of members, the side panels and the end panels hingedly connected together at adjacent edges by a pair of opposing inner hinges and a pair of opposing outer hinges which define corners in the cleated crate, wherein each inner and outer hinge comprises a pair of elongated members having a trapezoidal shape in cross-section which defines a neck surface and an opposing shoulder surface and an oblique surface and an opposing back surface, the elongated members in the inner hinges disposed in a first position in mirrored relation with the necks disposed side by side and the oblique surfaces defining a V-shaped channel on a side of the hinge; and a pair of U-shaped staples, each having a pair of legs and a bridge, driven into the butt ends of the pair of elongated members with the legs in respective ones of the adjacent elongated members and the bridge disposed substantially perpendicular to a line defined by the side-by-side neck surfaces, the inner hinge pivotable to a second position to bring the opposing oblique surfaces into engagement while disposing the pair of members at a perpendicular angle to define an angled corner post for the cleated crate;

the elongated members in the outer hinges disposed in a third position in mirrored relation with the distal edges of the members defined by the respective oblique surface and the shoulder surface in touching contact and the oblique surfaces defining a V-shaped channel on a side of the hinge; and a pair of plates disposed transverse to a longitudinal axis of the elongated members and attached at opposing distal ends for securing the pair of elongated members together, the outer hinge pivotable to a fourth position to bring the opposing oblique surfaces into engagement while disposing the pair of members at a perpendicular angle to define an angled corner post for the cleated crate, whereby the inner and outer hinges join the opposing side panels and opposing end panels at respective distal ends to define a tubular cleated body moveable from a first knocked-down position to a second squared-open position by moving the side panels in opposing directions to pivot the inner hinges to their second positions and the outer hinges to their fourth position, for receiving the squared-open cleated body on a pallet.

2. A hinge for a cleated crate for joining a side panel to an end panel, the side panel comprising a pair of spaced-apart, substantially parallel rails connected by a pair of spaced-apart transverse members and a pair of diagonal members extending at an oblique angle between a distal end portion of the transverse members to the opposing rails, the end panel comprising a pair of diagonally disposed members joined at an overlapping intersection of the pair of members, with an opposing pair of side panels and an opposing pair of end panels hingedly connected together at adjacent edges for defining a tubular cleated body for a cleated crate, comprising:

a pair of elongated members having a trapezoidal shape in cross-section which defines a neck surface and an opposing shoulder surface and an oblique surface and an opposing back surface;

the elongated members disposed in a first position in mirrored relation with the necks disposed side by side and the oblique surfaces defining a V-shaped channel on a side of the hinge; and a pair of U-shaped staples, each having a pair of legs and a bridge, driven into the butt ends of the pair of elongated members with the legs in respective ones of the adjacent elongated members and the bridge disposed substantially perpendicular to a line defined by the side-by-side neck surfaces, the inner hinge pivotable to a second position to bring the opposing oblique surfaces into engagement while disposing the pair of members at a perpendicular angle to define an angled corner post for the cleated crate.

3. A hinge for a cleated crate for joining a side panel to an end panel, the side panel comprising a pair of spaced-apart, substantially parallel rails connected by a pair of spaced-apart transverse members and a pair of diagonal members extending at an oblique angle between a distal end portion of the transverse members to the opposing rails, the end panel comprising a pair of diagonally disposed members joined at an overlapping intersection of the pair of members, with an opposing pair of side panels and an opposing pair of end panels hingedly connected together at adjacent edges for defining a tubular cleated body for a cleated crate, comprising:

a pair of elongated members having a trapezoidal shape in cross-section which defines a neck surface and an opposing shoulder surface and an oblique surface and an opposing back surface;

the elongated members disposed in a first position in mirrored relation with the distal edges of the members defined by the respective oblique surface and the shoulder surface in touching contact and the oblique surfaces defining a V-shaped channel on a side of the hinge; and a pair of plates disposed transverse to a longitudinal axis of the elongated members and attached at opposing distal ends for securing the pair of elongated members together, the outer hinge pivotable to a second position to bring the opposing oblique surfaces into engagement while disposing the pair of members at a perpendicular angle to define an angled corner post for the cleated crate.

* * * * *